United States Patent [19]

Leroy et al.

[11] 4,040,611

[45] Aug. 9, 1977

[54] DEVICE FOR CLAMPING THE BASE PLATE OF A STEEL REFINING CONVERTER

[76] Inventors: Pierre Leroy, 23, rue de Tourville, 78100 Saint-Germain-en-Laye, France; Emile Sprunck, 5, rue Joffre, 57250 Moyeuvre-Grande, France

[21] Appl. No.: 745,824

[22] Filed: Nov. 29, 1976

[30] Foreign Application Priority Data

Dec. 5, 1975 France ..... 75.37375

[51] Int. Cl.[2] ..... C21C 5/48

[52] U.S. Cl. ..... 266/243

[58] Field of Search ..... 266/218, 220–224, 266/243, 245, 246, 265, 268

[56] References Cited

U.S. PATENT DOCUMENTS 3,851,865 12/1974 Fisher ..... 266/222

*Primary Examiner*—Gerald A. Dost

[57] ABSTRACT

A device for clamping the base plate of a steel refining converter against a plate support ring attached to the casing of the converter comprises a plurality of rotatable brackets arranged to be beneath and around the circumference of the plate, each bracket being rotatable on a metal spindle passing through two parallel support flanges attached to the ring, and having a first shoulder with a very hard surface to be pressed against the base plate when the base plate is clamped in position, and an internally threaded second shoulder into which is screwed a retaining screw at the end of which is a ball which, when the base plate is clamped in position, engages in a semi-cylindrical groove in a metal bolt which engages in openings formed in each of said support flanges.

8 Claims, 10 Drawing Figures

FIG 1
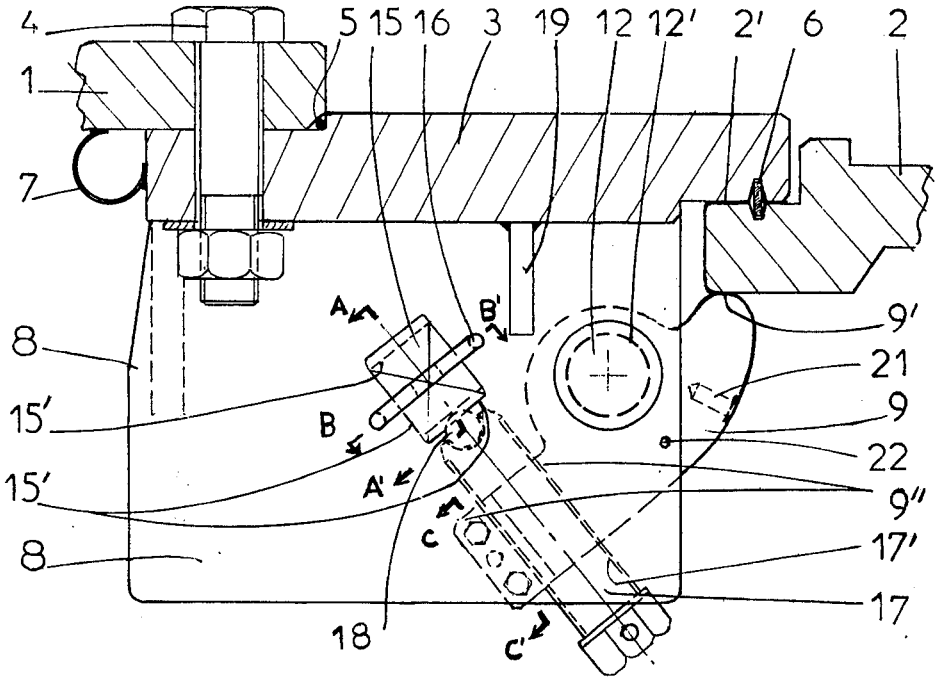
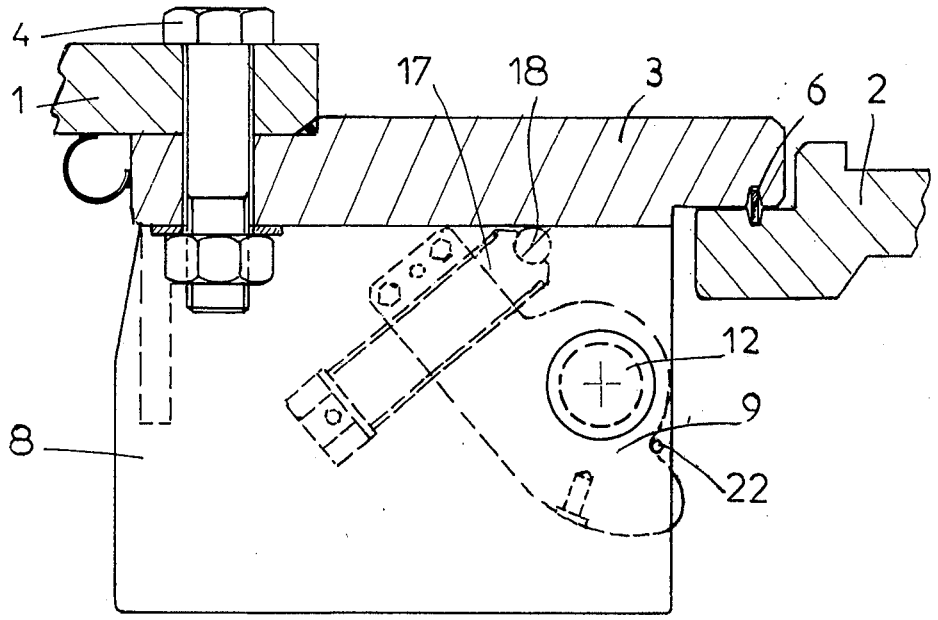
FIG 2

FIG 3
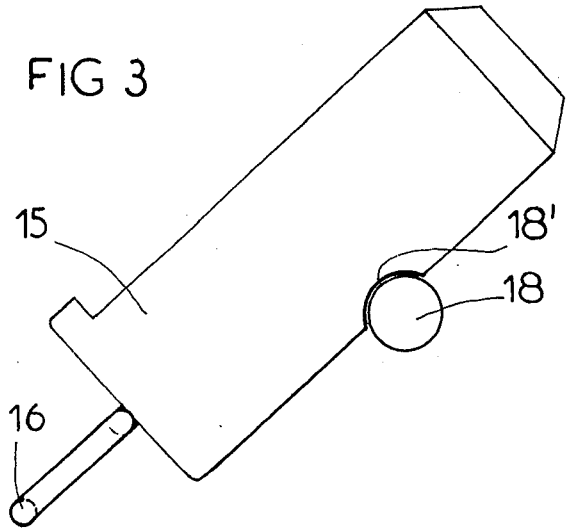
FIG 4
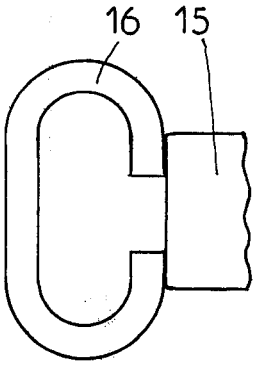
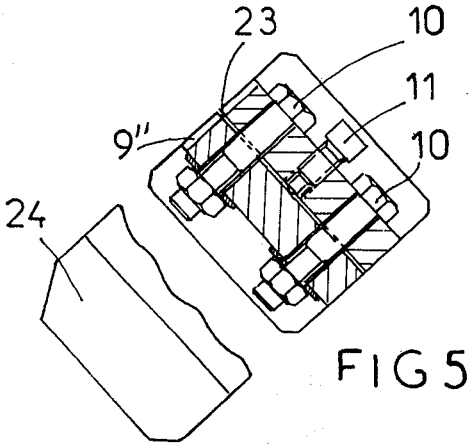
FIG 5
FIG 6
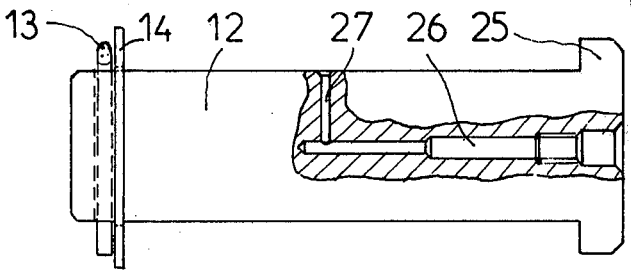

FIG 7
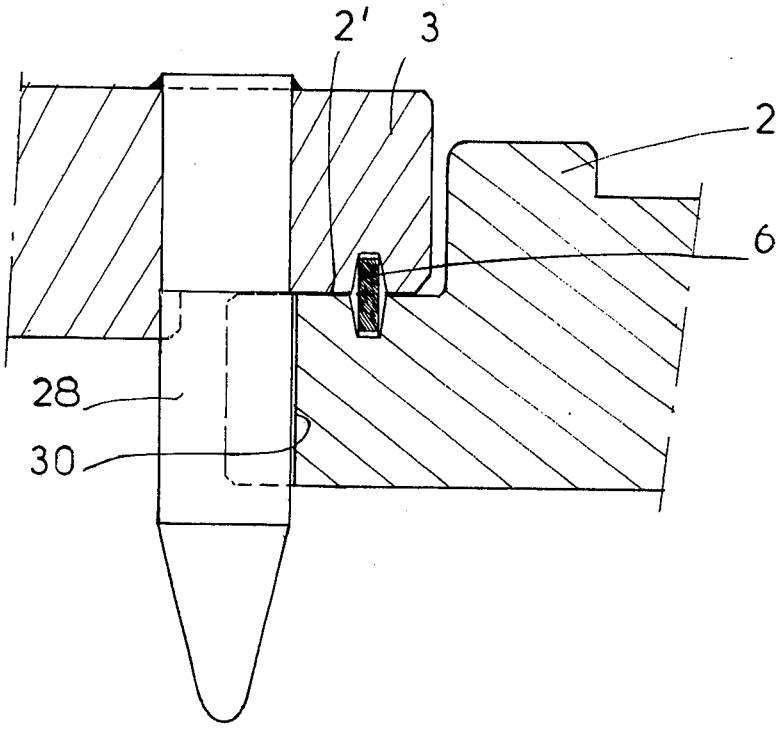
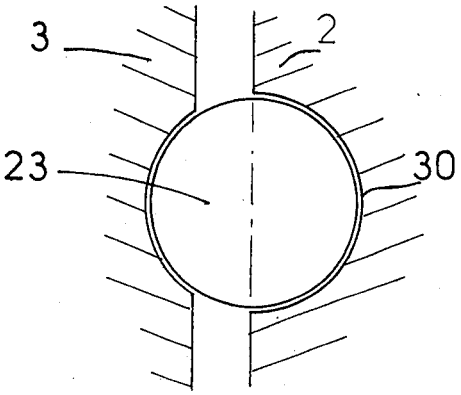
FIG 8
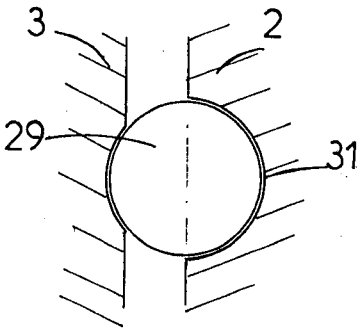
FIG 9

DEVICE FOR CLAMPING THE BASE PLATE OF A STEEL REFINING CONVERTER

The present invention concerns a clamping device for a base plate of a steel converter, the upper face of the plate being provided with a refractory lining called the base, which is usually brand new when it is fitted and worn when it is removed.

The invention is equally applicable to lanceblown converters with removable bases and all converters which are blown from the base by means of tuyeres.

The base plate and its refractory lining are usually fixed in position by means of wedges which are hammered into place between the plate and the ends of several brackets arranged around the perimeter of the plate, the other ends of the brackets being jammed into sockets in a cylindrical metal component attached to the casing of the converter.

The number of brackets and fixing wedges around the perimeter of the base plate is often limited, and there is no effective seal between the base plate and the metal ring of the converter casing against which it bears.

The aim of the present invention is to overcome all the disadvantages of the methods of attaching the base plates currently in use, thanks to a clamping system which is entirely different from known systems, and which eliminates all operations involving mechanical shocks.

It is an object of the invention to provide a device for clamping the base plate of a steel refining converter against a plate support ring attached to the casing of the converter, the device comprising:

a plurality of rotatable brackets arranged to be beneath and around the circumference of the plate;

a pair of parallel support flanges in respect of each bracket and attached to the ring;

means for mounting each bracket for rotation on a respective pair of flanges and between an operative clamping position and an inoperative position, said mounting means comprising a metal spindle which extends through the support flanges;

a metal bolt adapted to be engaged in openings formed in a respective pair of flanges and bearing a semi-cylindrical groove, wherein each said bracket has a first shoulder with a hard surface and arranged to bear against the base plate when the bracket is in its operative position, and a second internally threaded shoulder into which a retaining screw is threaded, the retaining screw being provided with a ball at one end which engages in the groove in the bolt when the bracket is in its operative position.

It is another object of the present invention to provide at least ten rotatable clamping brackets, equally spaced around the circumference of the base plate to be clamped.

In accordance with a further object of the present invention, the internal thread in the second shoulder of each rotatable bracket includes an anti-jamming device for the retaining screw and provided by a longitudinal slot between two flat lips, the distance between the lips being adjustable by means of clamping bolts and set accurately by means of a micro-meter screw.

In accordance with a further object of the present invention, a rounded portion of each bracket between the shoulders includes a cylindrical passage perpendicular to its surface for receiving a round bar for rotating the bracket on its spindle when required.

In accordance with another object of the present invention, each of the two support flanges for the spindle of each rotatable bracket includes a small cylindrical passage for receiving a pin for locking the bracket in its rest position, i.e., when it is not in the position for clamping the base plate.

In accordance with another object of the present invention, the spindle of each rotatable bracket consists of a cylindrical metal member with a head at one end, a diametral passage near its other end for receiving a fixing pin, and a threaded passage along part of its axis, the transverse cross-section of the passage decreasing in the direction away from the head and the passage communicating with the outside at the point at which the cross-section is smallest to allow for lubrication.

Another object of the invention is to provide means for locating the base plate relative to the plate support ring wherein the ring is fitted with two downwardly-extending pins which are of different diameters and which are located at diametrically opposite points on the ring, while the base plate has semi-circular openings at diametrically opposite points on its perimeter, the diameters of which correspond to those of the respective pins of the support ring.

This locating device is used to position the base plate correctly against the support ring as it is raised into place by means of conventional jacks, immediately before it is clamped in position by means of the rotatable brackets described above.

It will be understood that one of the main advantages of the base plate clamping device in accordance with the invention is the avoidance of violent mechanical shocks, since the clamping and releasing of the plate are effected simply by rotating the brackets, which are locked or unlocked by means of screws and bolts.

Another important advantage is the ability to control the degree of clamping by adjusting the retaining screw and ball and the anti-jamming device of this screw.

As a result, the base plate stands up better in use, and there is a better seal between the plate and its support ring.

The invention will be more fully understood from the following description of an embodiment thereof, given by way of example only with reference to the accompanying drawings.

In the drawings:

FIG. 1 is a partial vertical cross-section through the base of the casing of a converter, the plate support ring, the base plate, and a bracket in accordance with the invention, fitted with its bolt, in the position in which the plate is clamped on to the casing;

FIG. 2 is a partial vertical cross-section through the same set of elements (minus the bolt), in the position in which the bracket in question is released;

FIG. 3 is a transverse cross-section through the bolt and its handle, on the line AA';

FIG. 4 is a partial transverse cross-section through the bolt and its handle on the line BB';

FIG. 5 is a transverse cross-section through the anti-jamming device for the bracket retaining screw, on the line CC' of FIG. 1;

FIG. 6 is a longitudinal cross-section through the spindle of the bracket in question;

FIG. 7 is a vertical cross-section through a locating pin of the base plate 2 on the support ring 3;

FIG. 8 is a transverse cross-section through the larger of the two locating pins, on the plane common to the members 2 and 3;

FIG. 9 is a transverse cross-section through the smaller of the two pins, in the same plane.

Figure 10:
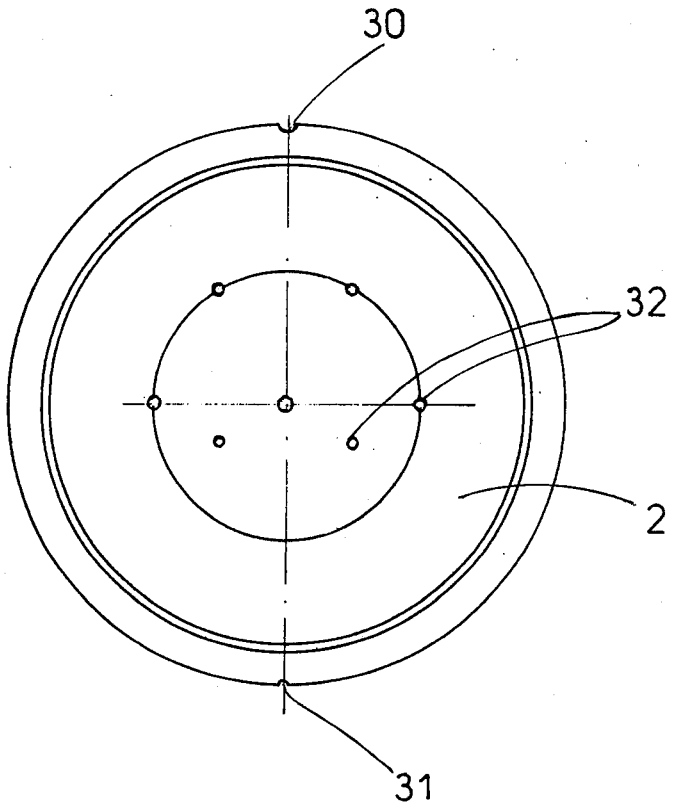
FIG. 10 shows a base plate provided with two locating openings.

Referring to FIGS. 1 and 2, to the base 1 of the casing of the converter is attached a metal support ring 3 by bolts 4. Conventional seals 5 and 7 are provided between the base 1 and ring 3.

The base plate 2 bears against the edge of the ring 3 along a circular surface 2' and a circular seal 6 is provided at the surface 2'. The base plate 2 is clamped to the ring 3 by a plurality of clamping devices mounted on the ring and spaced about the circumference of the plate.

Each device includes two thick plates forming two parallel flanges 8, only one of which can be seen in FIGS. 1 and 2. The two flanges 8 are connected to one another by means of gussets 19 and 20 welded to the two flanges 8 and to the support ring 3.

A bracket 9 is provided which can pivot on a spindle 12 which is fitted in bearings 12' machined in each of the two flanges 8.

A first shoulder 9' of the bracket 9 is adapted to bear against the base plate 2 to clamp the base plate to the ring 3. Its surface is coated with Stellite to provide a very hard surface.

A second shoulder 9" of the bracket 9 receives a retaining screw 17 which is threaded into a threaded bore 17' in the shoulder 9" and which has at its end a ball 18. The shoulder 9" is fitted with a device for avoiding jamming of the retaining screw 17, and which will be described later with reference to FIG. 5. The ball 18 can be screwed into engagement with a bolt 15, the ball 18 bearing on the bottom of a semi-cylindrical groove 18" (FIG. 3) in the bolt.

Because of this stop action, the final stage of screwing the screw 17 into the female threaded bore 17' of the shoulder 9" rotates the bracket 9 and applies the first shoulder 9' very firmly against the plate 2.

In the preferred embodiment, the basic diameter of the retaining screw is 64 mm; the diameter of the ball 18 at its end is 40 mm. The distance between the axis of the screw 17 and the rotation axis of the bracket 9 is 150 mm.

In the rounded face of the bracket 9 there is provided a cylindrical opening 21 which is 25 mm in diameter and into which a round bar of slightly smaller diameter can be inserted.

The bolt 15 and its handle 16 can be clearly seen in FIGS. 1, 3 and 4. In the locking position, the bolt 15 is inserted into openings 15' in each of the flanges 8.

To unlock the device, the retaining screw 17 is first unscrewed until the ball 18 leaves the groove 18'. The bolt 15 can then be withdrawn by means of its handle 16.

A bar with a diameter of 25 mm is then inserted into the cylindrical opening 21 in the bracket 9, and the bracket is rotated (clockwise as seen in FIGS. 1 and 2) until it takes up the position shown in FIG. 2, in which the ball 18 abuts the support ring 3. The bracket 9 is then locked in this position by means of a pin inserted into an opening 22 in each of the flanges 8, in the region of the rounded concave portion at the root of the first shoulder 9' of the bracket 9. When the 12 brackets have been locked in the retracted position in this manner, the base plate and the refractory base can be removed.

The anti-jamming device for the retaining screw 17 is shown in FIG. 5.

The shoulder 9" has a longitudinal slot 23 with two flat lips 24. The lips are clamped by means of two bolts 10. The small distance between them can be accurately adjusted by means of a micrometer screw 11. The amount of friction between the retaining screw 17 and the female thread in the bore 17' in the shoulder 9' of the bracket 9 can be controlled in this way, in dependence on variable local conditions such as the wear of the thread, the force to be exerted on the base plate by the shoulder 9', etc. In the preferred embodiment the basic diameter of the bolts 10 is 18 mm.

The spindle 12 of the bracket 9 is shown in detail in FIG. 6. It is an elongate cylindrical member with a diameter of 80 mm and a length of 280 mm, and with a head 25 which is 110 mm in diameter and 20 mm thick. Close to the end opposite the head 25, the spindle 12 is provided with a diametral passage into which a fixing pin 13 can be inserted, after placing a washer 14 between the pin and one of the two bracket support flanges 8, the head 25 bearing against the other flange.

Along the axis of the spindle 12 is a threaded passage 26 which is 155 mm long, and with a cross-section which decreases in the direction away from the head 25. A threaded rod of suitable design can be introduced into this passage to withdraw the spindle 12 from its two housings 12', after removing the pin 13.

A small passage 27 which is 5 mm in diameter and perpendicular to the passage 26 provides communication between the latter, at the point where its cross-section is smallest, and the outside, for lubrication.

Reference will now be had to FIGS. 7 to 10, which are concerned with a device for locating the base plate before it is clamped by the brackets.

At diametrically opposite points, the support ring 3, against which the base plate 2 bears, is fitted with two pins 28 and 29. The larger pin 28 has a diameter of 70 mm and the smaller pin 29 has a diameter of 50 mm.

The base plate 2 has two semi-circular openings 30 and 31. The larger opening 30 has a radius of 37 mm, and matches the pin 28, while the smaller opening 31 has a radius of 27 mm and matches the pin 29. When the base plate is lifted into place by means of jacks, it is ensured that the plate will be correctly located relative to the ring 3 and therefore relative to the converter as a whole. This is important for the location of the blowing tuyeres in the case of a converter which is blown from the base. FIG. 10 shows seven orifices 32 which are formed in the plate for the passage of seven blowing tuyeres, which have well-defined positions relative to the converter which must not be changed.

Thus the invention enables the base plate 2 to be located and clamped to the support ring 3 without any mechanical shock.

It will be understood that modifications may be made and details improved on, or equivalent means used, without departing from the scope of the invention.

What is claimed is:

1. A device for clamping the base plate of a steel refining converter against a plate support ring attached to the casing of the converter, the device comprising:

a plurality of rotatable brackets arranged to be beneath and around the circumference of the plate;

a pair of parallel support flanges in respect of each bracket and attached to the ring;

means for mounting each bracket for rotation on a respective pair of flanges and between an operative clamping position and an inoperative position, said mounting means comprising a metal spindle which extends through the support flanges;

a metal bolt adapted to be engaged in openings formed in a respective pair of flanges and bearing a semi-cylindrical groove, wherein each said bracket has a first shoulder with a hard surface and arranged to bear against the base plate when the bracket is in its operative position, and a second internally threaded shoulder into which a retaining screw is threaded, the retaining screw being provided with a ball at one end which engages in the groove in the bolt when the bracket is in its operative position.

2. A device according to claim 1, including at least ten of said rotatable clamping brackets.

3. A device according to claim 1, wherein the second shoulder of each rotatable bracket includes means for avoiding jamming of the retaining screw in the second shoulder, said means comprising a longitudinal slot between two flat lips, the distance between the lips being adjustable by means of bolts and accurately set by means of a micrometer screw.

4. A device according to claim 1, wherein a rounded portion of each rotatable bracket between the shoulders includes a cylindrical passage perpendicular to its surface for receiving a bar for rotating the bracket on its spindle.

5. A device according to claim 1, wherein each of the support flanges on each rotatable bracket includes a cylindrical passage for receiving a pin for locking the bracket in its inoperative position.

6. A device according to claim 1, wherein the spindle of each rotatable bracket includes a cylindrical metal member having a head at one end, a diametral passage near its other end for receiving a fixing pin, and a threaded passage extending along part of its axis, the transverse cross-section of the passage decreasing in the direction away from the head and the passage communicating with the outside at the point where the cross-section is smallest to allow for lubrication.

7. A device for locating the base plate before it is clamped by a device according to claim 1, wherein the plate support ring is fitted with two downwardly extending pins which are of different diameters and located at diametrically opposite points on the ring, and the base plate has semi-circular openings at diametrically opposed points on its perimeter, the diameters of which correspond to those of the respective pins of the support ring.

8. A device as claimed in claim 1, wherein each said bolt is removable from engagement in said openings in said flanges.

* * * * *